US005191668A

United States Patent [19]

Euler et al.

[11] Patent Number: 5,191,668

[45] Date of Patent: Mar. 9, 1993

[54] SPIN METHOD OF RINSING FABRIC IN A HORIZONTAL AXIS WASHER

[75] Inventors: John W. Euler, St. Joseph; Mark B. Kovich, St. Joseph Township, Berrien County; Sheryl L. Farrington, Lincoln Township, Berrien County; Jim J. Pastryk, Weesaw Township, Berrien County; Jeanne C. Van Newenhizen, Benton Township, Berrien County; Anthony H. Hardaway, Lincoln Township, Berrien County, all of Mich.

[73] Assignee: Whirlpool Corporation, Benton Harbor, Mich.

[21] Appl. No.: 815,784

[22] Filed: Jan. 2, 1992

[51] Int. Cl.[5] ..... D06B 1/02; D06F 23/02

[52] U.S. Cl. ..... 8/158; 8/159; 68/23.5; 68/58

[58] Field of Search ..... 8/158, 159; 68/23.5, 68/12.4, 58

[56] References Cited

U.S. PATENT DOCUMENTS

| | | | |
|---|---|---|---|
| 2,966,052 | 12/1960 | Syles | 68/58 |
| 3,093,842 | 6/1963 | Buss | 8/159 |
| 3,197,980 | 8/1965 | Marple | 68/12 |
| 3,650,673 | 3/1972 | Ehner | 8/137 |
| 3,811,300 | 5/1974 | Barton et al. | 68/12 R |
| 4,118,189 | 10/1978 | Reinwald et al. | 8/137 |
| 4,432,111 | 2/1984 | Hoffmann et al. | 8/158 |
| 4,489,455 | 12/1984 | Spendel | 8/158 |
| 4,489,574 | 12/1984 | Spendel | 68/16 |
| 4,696,171 | 9/1987 | Babuin | 68/207 |
| 4,784,666 | 11/1988 | Brenner et al. | 8/158 |
| 4,987,627 | 1/1991 | Cur et al. | 8/158 |

FOREIGN PATENT DOCUMENTS 209436 7/1957 Australia .

*Primary Examiner*—Theodore Morris
*Assistant Examiner*—Saeed T. Chaudhry
*Attorney, Agent, or Firm*—Stephen D. Krefman; Thomas J. Roth; Thomas E. Turcotte

[57] ABSTRACT

The present invention contemplates a rinse process which can be used with any cycle, but which has particular utility following a wash cycle have a highly concentrated detergent solution.

The method of rinsing fabric provided by the present invention is useful in a washer having a wash chamber rotatable about a horizontal axis. The steps undertaken in the method begin with loading fabric to be washed into the wash chamber of the washer. The fabric is then washed in a detergent solution while rotating the wash chamber about its horizontal axis for a first period of time. Next the detergent solution is drained from the wash chamber. The fabric is then rinsed by adding water to the wash chamber while spinning the wash chamber at a speed to effect more than a one gravity centrifugal force on the fabric such that the fabric will not tumble within the wash chamber as it spins. Finally, the wash chamber is drained of the rinse water.

16 Claims, 6 Drawing Sheets

SPIN METHOD OF RINSING FABRIC IN A HORIZONTAL AXIS WASHER

BACKGROUND OF THE INVENTION

The present invention relates to a method of rinsing fabric in an automatic clothes washer and more particularly to a spinning rinse method in a horizontal axis clothes washer.

Attempts have been made to provide an automatic clothes washer which provides comparable or superior wash results to present commercially available automatic washers, yet which uses less energy and water. For example, such devices and wash processes in a vertical axis machine are shown and described in U.S. Pat. Nos. 4,784,666 and 4,987,627, both assigned to the assignee of the present application, and incorporated herein by reference.

The basis of these systems stems from the optimization of the equation where wash performance is defined by a balance between the chemical (the detergent efficiency and water quality), thermal (energy to heat water), and mechanical (application of fluid flow through—fluid flow over—fluid impact—fabric flexing) energy inputs to the system. Any reduction in one or more energy forms requires an increase in one or more of the other energy inputs to produce comparable levels of wash performance.

U.S. Pat. No. 4,489,455 discloses a horizontal axis washer which utilizes a reduced amount of wash fluid in a washing cycle in which the wash fluid is applied on to the fabric load and then the load is tumbled in the presence of the wash fluid for a given period of time. Recirculation of the wash liquid does not occur.

U.S. Pat. No. 3,197,980, assigned to the assignee of the present invention, discloses a horizontal washer and wash cycle in which the clothes load is subjected first to a deep fill to thoroughly wet all of the clothes, half the water is then removed from the washer and a normal detergent supply is introduced into the remaining wash bath. Thus, a "concentrated" detergent solution in the range of 0.40% to 0.50% by weight is applied to the clothes load during a tumbling agitation of the clothes Recirculation of the wash fluid during this "concentrated" wash cycle is also disclosed. Following the "concentrated" portion of the wash cycle, the tub is refilled to a deep fill volume which dilutes the detergent concentration to the normal concentration of 0.20% to 0.25%. An additional tumble period at the normally recommended detergent concentration then occurs.

Various rinse techniques have been proposed for removing detergent and dirt from the clothes load after the washing cycle, however, most of those rinse methods use a large amount of water or are not effective to remove a highly concentrated detergent solution or avoid redeposition of removed dirt onto the clothes load.

Significantly greater savings in water usage and energy usage than is achieved by heretofore disclosed wash systems and methods would be highly desirable.

SUMMARY OF THE INVENTION

A horizontal axis washer system incorporating the principles of the present invention utilizes a basket structure and fluid conduits and valves which complement specifically increasing the level of chemical contributions to the wash system, therefore permitting the reduction of both mechanical and thermal inputs.

The utilization of concentrated detergent solution concepts in the wash portion of the cycle permits the appliance manufacturer to significantly reduce the amount of thermal and mechanical energy applied to the clothes load, through the increase of chemistry a minimum of thirteen fold and maximum up to at least sixty-four fold, while approximating "traditional" cleaning levels, yet reducing the energy and water usage. This translates to washing with reduced water heating, reduced water consumption, and minimal mechanical wash action to physically dislodge soils. A concentrated detergent solution is defined in U.S. Pat. No. 4,784,666 as 0.5% to 4% detergent by weight. It is anticipated now, however, that a concentrated detergent solution may be as high as 12% by weight.

The present invention contemplates a rinse process which can be used with any wash cycle, but which has particular utility following a wash cycle have a highly concentrated detergent solution.

The method of rinsing fabric provided by the present invention is useful in a washer having a wash chamber rotatable about a horizontal axis. The steps undertaken in the method begin with loading fabric to be washed into the wash chamber of the washer. The fabric is then washed in a detergent solution while rotating the wash chamber about its horizontal axis for a first period of time. Next the detergent solution is drained from the wash chamber. The fabric is then rinsed by adding water to the wash chamber while spinning the wash chamber at a speed to effect more than a one gravity centrifugal force on the fabric such that the fabric will be prevented from tumbling within the wash chamber as it spins. Finally, the wash chamber is drained of the rinse water.

DESORIPTION OF THE PREFERRED EMBODIMENTS

Washer and Fluid Flow Path Construction

Figure 1:
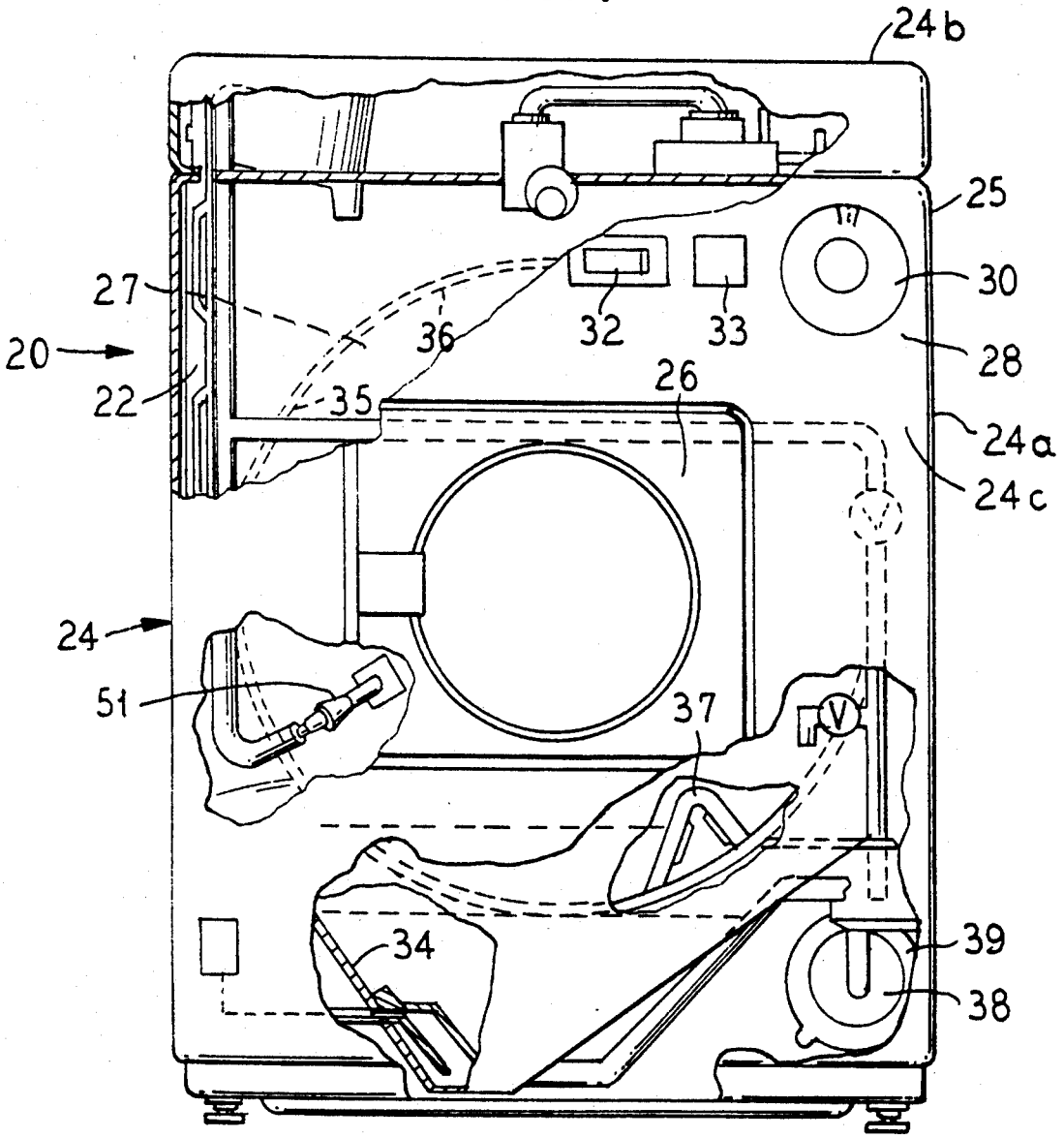
FIG. 1 is a front view of an automatic washer, partially cut away to illustrate various interior components.
Figure 2:
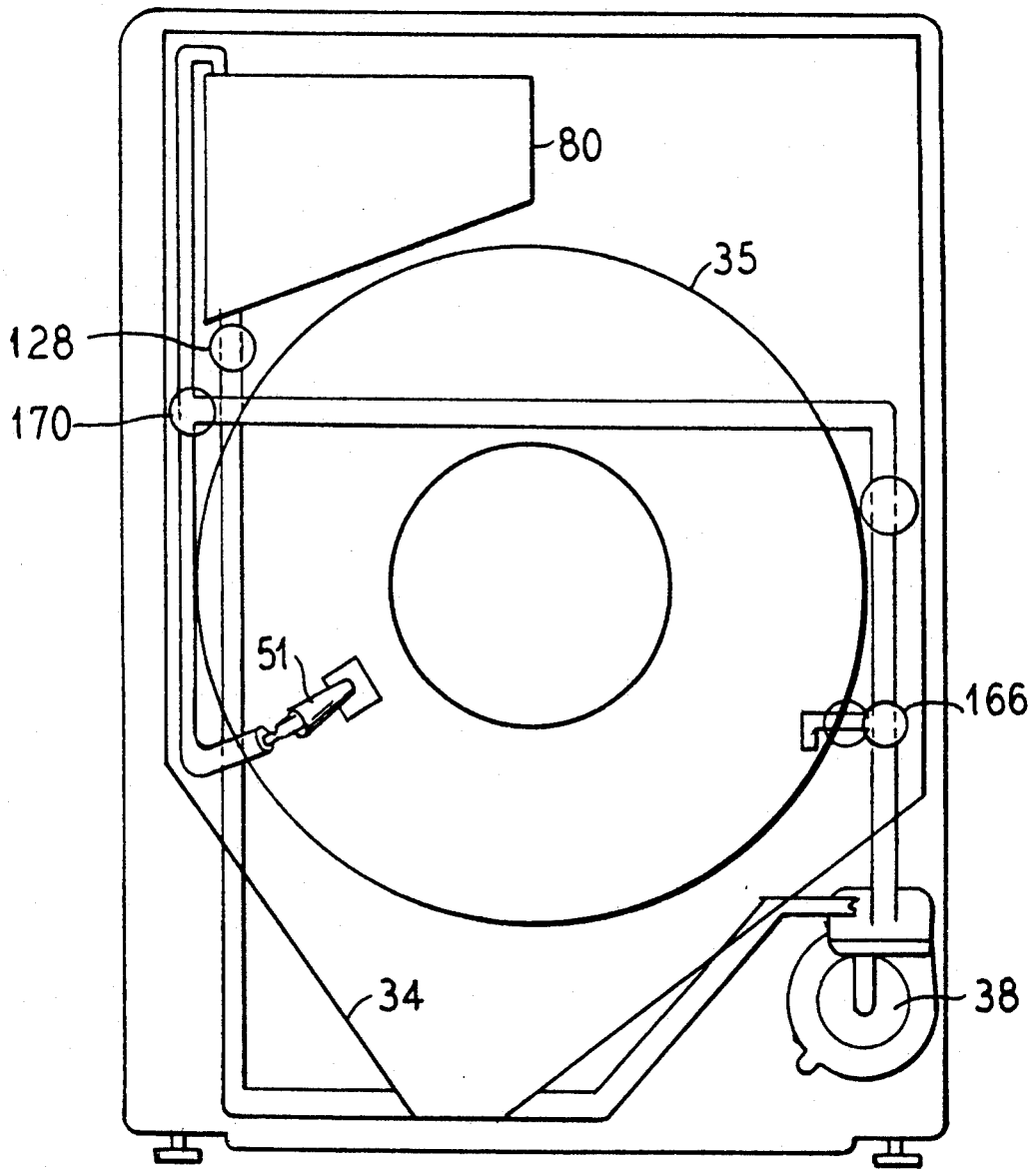
FIG. 2 is a partial front elevational view of the washer of FIG. 1 with the outer wrapper removed to illustrate the interior components.

In FIG. 1, reference numeral 20 indicates generally a washing machine of the automatic type, i.e., a machine having a pre-settable sequential control means for operating a washer through a preselected program of automatic washing, rinsing and extracting operations in which the present invention may be embodied. The machine 20 includes a frame 22 carrying vertical panels 24 forming the sides **24*a*, top 24*b*, front 24*c* and back of the cabinet 25 for the washing machine 20**. A hinged door 26 is provided in the usual manner to provide access to the interior or treatment zone 27 of the washing machine 20. The washing machine 20 has a console 28 including a timer dial 30 or other timing mechanism and a temperature selector 32 as well as a cycle selector 33 and other selectors as desired.

Internally of the machine 20 described herein by way of exemplifications, there is disposed an imperforate fluid containing tub 34 within which is a spin basket 35 with perforations or holes 36 therein, while a pump 38 is provided below the tub 34. The spin basket 35 defines a wash chamber A motor 39 is operatively connected to the basket 35 to rotate the basket relative to the stationary tub 34.

Figure 3:
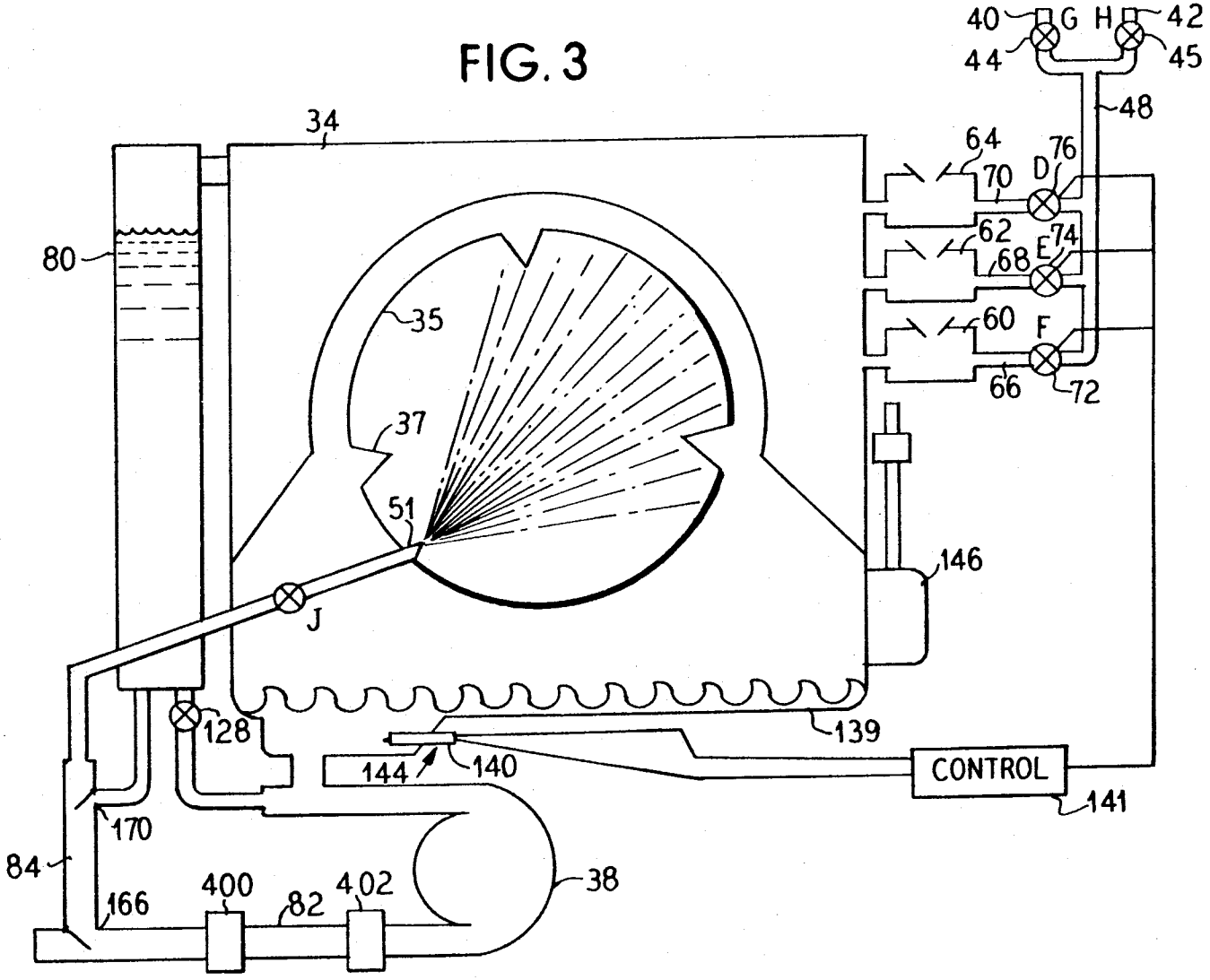
FIG. 3 is a schematic illustration of the fluid conduits and valves associated with the automatic washer.

Water is supplied to the imperforate tub 34 by hot and cold water supply inlets 40 and 42 (FIG. 3). Mixing valves 44 and 45 in the illustrated dispenser design are connected to conduit 48. There are provided a plurality of wash additive dispensers 60, 62 and 64 as seen in FIG. 3. Dispensers 60 and 62 can be used for dispensing additives such as bleach or fabric softeners and dispenser 64 can be used to dispense detergent (either liquid or granular) into the wash load at the appropriate time in the automatic wash cycle. As shown schematically in FIG. 3, each of the dispensers 60, 62 and 64 are supplied with liquid (generally fresh water or wash liquid) through a separate, dedicated conduit 66, 68, 70 respectively. Each of the conduits 66, 68 and 70 may be connected to a fluid source in a conventional manner, as by respective solenoid operated valves (72, 74 and 76 FIG. 3), which contain built-in flow devices to give the same flow rate over wide ranges of inlet pressures, connecting each conduit to the manifold conduit 48.

A mixing tank 80, as shown in FIG. 3, forms a zone for receiving and storing a concentrated solution of detergent during the wash cycle, and is used in some embodiments of the invention. As will be described in greater detail below, the mixing tank 80 communicates at a top end with the wash tub 34 and at a lower end communicates with the pump 38, a drain line or conduit 82 and a recirculating conduit 84. The mixing tank 80 may be similar to that disclosed in U.S. Pat. No. 4,784,666.

As described above, the detergent dispenser 64 is provided with a supply of fresh water through conduit 70. Other types of detergent dispensers can, of course, be used with the present invention, including dispensers which hold more than a single charge of detergent and dispense a single charge for each wash cycle.

Positioned within the tub 34, near a bottom wall 139 thereof is a liquid sensor means which may be in the form of a liquid level sensor 140. Such a sensor can be of a number of different types of sensors including a conductivity probe 142 (FIG. 5A), a temperature thermistor 144 (FIG. 3) or a pressure dome 146 (FIG. 5B). Regardless of the liquid sensor type, the liquid sensor must be able to detect either the presence of liquid detergent solution and/or the presence of suds within the tub. A sensor which detects the depth of liquid within the tub may also be utilized When the sensor makes the required detection, it sends an appropriate signal to a control device 141, as is known in the art, to provide the appropriate control signals to operate the various valves as required at that portion of the wash cycle. As is described in greater detail below the liquid sensor 140 is used to maintain a desired level of wash liquid within the tub 34 during the recirculating portion of the concentrated wash cycle.

Figure 5A:
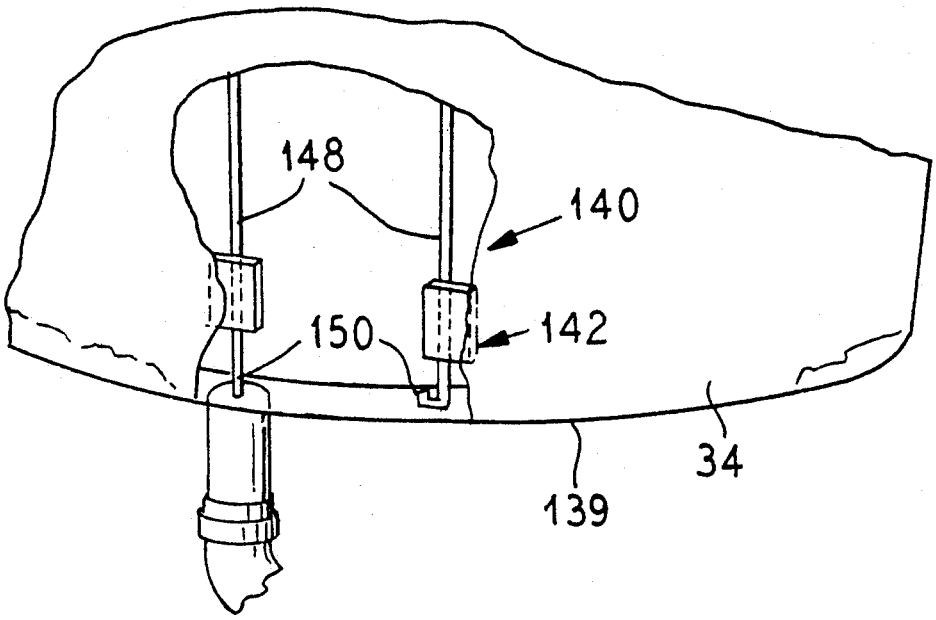
FIG. 5A is a sectional view of the wash tub illustration an electrical probe liquid level sensor.
Figure 5B:
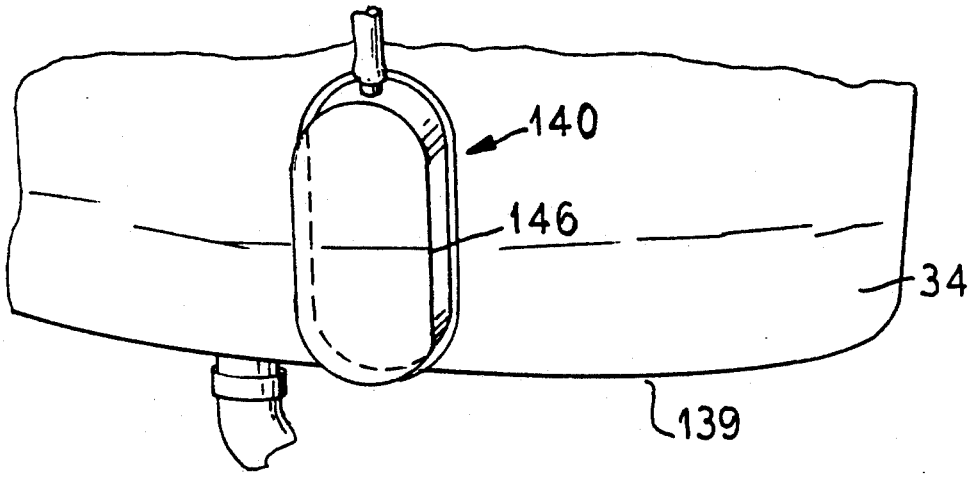
FIG. 5B is a side sectional view of the use of a pressure dome as a liquid level sensor in the wash tub.

The probe sensor 142, shown in FIG. 5A, consists of two insulated stainless steel electrodes 148 having only the tips 150 exposed in the tub 34. When the detergent solution or suds level raises high enough to contact both electrodes, the low voltage circuit is completed indicating the sensor is satisfied.

A thermistor system 144, as generally indicated in FIG. 3, is also located in the tub 34 and is triggered when the water or suds level rises to the designated level, thus cooling the sensor element.

A pressure dome sensor 146, as shown in FIG. 5B and FIG. 3, is similar to pressure domes normally utilized determining liquid level within an automatic washer tub, however it is the positioning of the dome near the bottom of the tub 34 or in a sump, rather than on the upper side of the tub which is the major difference between its usage here and its traditional usage. If a pressure dome sensor 146 is utilized, it must have a setting for spin/spray usage. An indirect inference of water level in the tumble portion of the cycle based on the level of the detergent liquor can be used via algorithms. A pressure dome sensor may also be beneficial as a sensor to detect an over sudsing condition. If the suds level is too high, then the sensor does not reset The failure to reset is a means for terminating a spray/spin wash proceeding with the tumble portion of the wash cycle.

Basket Construction

The washer basket 35 has a plurality of inwardly directed baffles 37 to engage and lift the fabric as the basket rotates about its horizontal axis. The wash basket also is provided with a series of apertures 36 therethrough to permit fluid flow through the basket. When the basket rotates at a sufficiently high speed, the fabric will be held against the wall of the basket in that a centrifugal force in excess of the force of gravity will be applied to the fabric, thus preventing the fabric from moving relative to the basket wall. However, when the basket is rotated below a predetermined speed, less than one gravity of centrifugal force will be applied to the fabric, thus permitting the fabric to tumble within the basket. As described below, one or both of these spin actions may be applied during the preferred wash cycle.

An optional in-line water heater 400 (FIG. 3), or an immersion heater in the sump, offers the ability to increase the concentrated wash liquor to an elevated temperature level, thus providing high temperature wash performance at the reduced cost of heating one to one and half gallons of water. This compares to the cost of heating four to five gallons of water in a traditional horizontal washer. The controlled use of an in-line heater 400 combined with high concentrated wash liquor offers special opportunities for specific optimization of detergent ingredients which are activated only in specific temperature ranges. Furthermore, the elevated water temperatures offer the ability to specifically target oily soil removal and reduce the build-up of both saturated and poly-unsaturated oils in fabrics laundered in cold water.

The use of an in-line lint, button, sand and foreign object trap or filter 402 significantly reduces the potential for problems associated with recirculating fluid systems carrying soils and foreign materials. Such a filter is disclosed in U.S. Pat. No. 4,485,645, assigned to the assignee of the present invention, and incorporated herein by reference. Such optional devices would be utilized in a preferred system.

Wash Cycle

Figure 4:
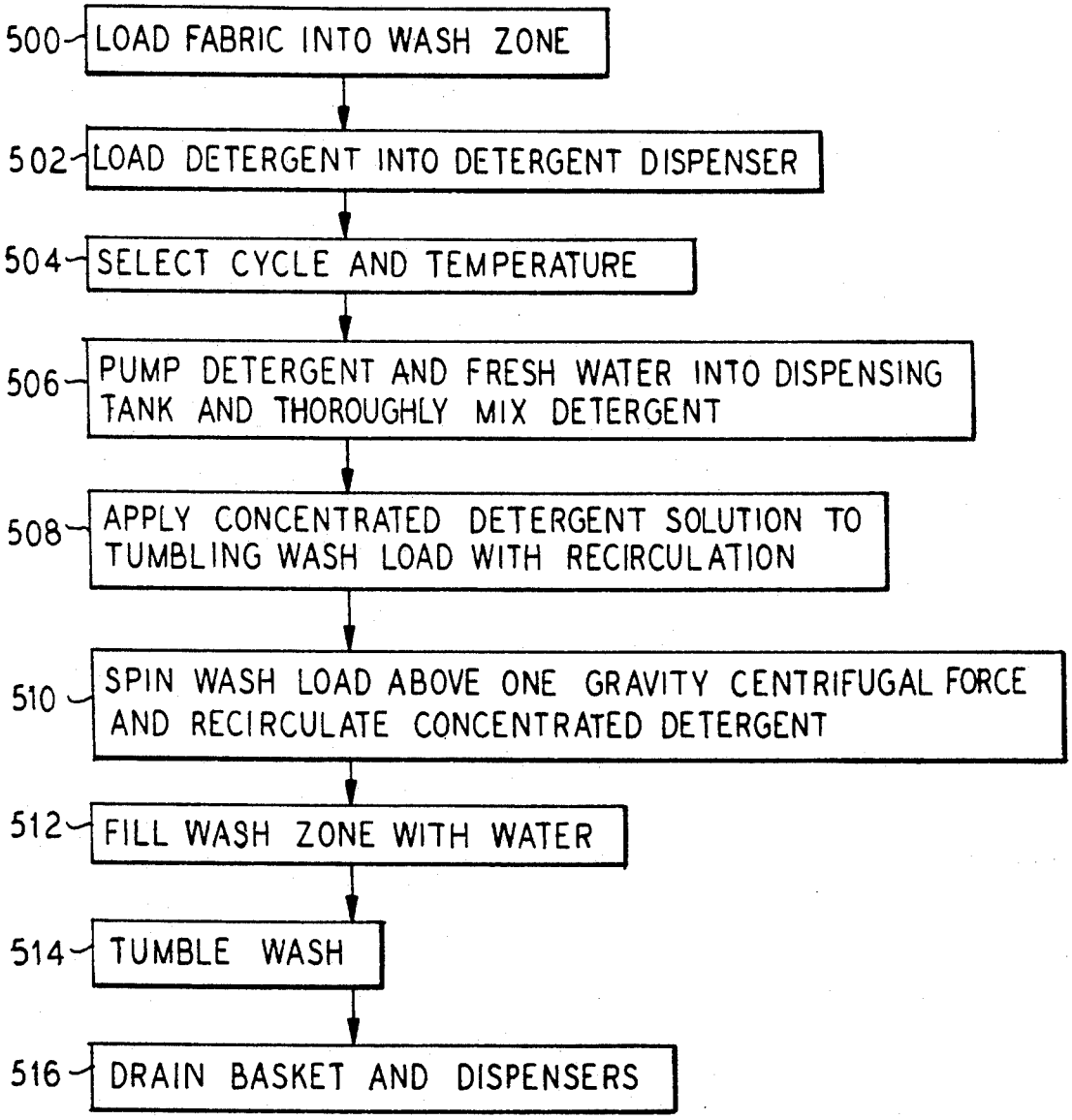
FIG. 4 is a flow chart diagram of the steps incorporated in the concentrated wash cycle.

An improved wash and rinse cycle is provided in accordance with the present invention and is shown schematically in FIG. 4. In step 500, the washer is loaded with clothes as would be standard in any horizontal axis washer. In step 502, the detergent; liquid, powdered, and/or other detergent forms, is added to the washer, preferably through a detergent dispenser, such as the detergent dispenser 64 illustrated, and mixing tank, such as tank 80, at the dosage recommended by the detergent manufacturer for a particular sized wash load. It is possible to add the detergent directly to washer through the basket or directly into the tub through a direct path. The consumer then selects the desired cycle and water temperature in step 504.

A 3-way drain valve 166 and a 3-way detergent mixing valve 170 are turned on and the detergent tank control valve 128 and the detergent water valve 76 are opened. A time delay (approximately 30 seconds) is used to input wash water after which the detergent water valve 76 is closed. As the washer fills, the detergent is washed from the dispenser 64 into the tub 34, past the drain and mixing tank valves 166, and into the mixing tank 80. A time delay (approximately 15 seconds) provide mixing of the detergent with wash water by recirculating the solution in a loop controlled by the valves as indicated by step 506. The detergent is only diluted to a highly concentrated level of approximately 0.5% to 12% by weight detergent. The washer basket 35 begins a low speed spin. The preferred speed allows uniform coverage of the concentrated detergent liquor onto the clothes load.

Concentrated Wash Cycle

In step 508, the detergent tank control valve 128 is closed and a time delay of approximately 15 seconds, but dependent on the size of the mixing tank 80, causes the mixing tank to fill with the detergent solution. The detergent mixing valve 170 is turned off permitting the detergent solution to leave the closed loop and to be sprayed onto the spinning clothes load via a nozzle 51 whose arrangement can be from any point internal to the basket. The preferred position provides a spray pattern perpendicular to the clothes load tumbling path in both bidirectional and unidirectional tumbling systems.

During the initial introduction of concentrated detergent solution on to the clothes load, the wash basket is spun at a speed slow enough to effect less than a one gravity centrifugal force on the clothes load, thus resulting in the clothes load tumbling within the basket. After the concentrated detergent solution is sprayed on the clothes, the solution then travels through the basket 35, into the tub 34, down through the pump 38 to be sprayed through the nozzle 51 creating a recirculation loop. The preferred system utilizes a pump exclusively for the recirculation. This ensures sufficient concentrated liquid flow rates without losses due to slower pump speeds associated directly with the drive system. Less effective systems could also use the main pump of the wash system.

This step concentrates the effectiveness of the chemistry thus permitting maximum soil removal and minimum soil redeposition even under adverse washing conditions. The high concentrations of detergent ingredients significantly increases the effectiveness of micelle formation and sequestration of oily and particulate soils and water hardness minerals, thus providing improved performance of surfactants, enzymes, oxygen bleaches, and builder systems beyond level achievable under traditional concentrations.

The water level sensor 140, located near the tub bottom, or in the sump, begins to monitor water level concurrent with the opening of the detergent mixing valve 170. Water level control is critical. Too much detergent solution added will create an over sudsing condition by allowing the spinning basket to contact detergent solution in the bottom of the tub. The preferred method of control is to maintain a minimum level of detergent liquor in the bottom of the tub through the water level sensor. While results suggest that some type of tub modifications (resulting in a sump) permits the washer to function under a wide range of conditions, there are many more common conditions which do not require a tub sump.

A satisfied sensor 140 indicates the system does not require any additional detergent solution at this point in the cycle and the detergent tank valve 128 is closed to maintain the current level of detergent. A satisfied water level sensor 140 early in the wash cycle generally indicates either a no clothes load situation or a very small clothes load. If the sensor is not satisfied, then the detergent tank control valve 128 is opened permitting the addition of detergent solution followed by a five second time delay before again checking the water level sensor 140. If the sensor 140 is satisfied, the detergent tank control valve 128 is closed to maintain the new level of detergent and a thirty second time delay begins to permit the clothes load a chance to come to equilibrium with respect to water retention and the centrifugal forces of extraction created by the spinning basket.

In the preferred embodiment of the invention a mixing tank in not utilized, rather, the detergent is mixed in the bottom of the tub or in the sump there is one. The water level control is provided by a pressure switch in the bottom of the tub, or in the sump, which does provide water level control as a function of clothes load.

In a preferred wash method, the spin speed is then increased to a level to cause a centrifugal force to be applied against the clothes load in excess of one gravity so that the clothes load will be held against the spinning basket wall. The concentrated detergent solution is forced through the clothes load and through the basket holes due to the centrifugal forced imparted by the spinning basket with potential significant contributions by mechanical fluid flow through the fabric defined by the pumping rate of the detergent liquor. During this step (510) the concentrated detergent solution will be recirculated through the clothes load for some predetermined period of time specified by the cycle type. That is, a cycle seeking maximum performance may recirculate the detergent solution through the clothes for 14 minutes or more, while a more delicate or less soiled load will attempt to minimize the length of spinning. The water level sensor 140 monitors the tub 34, adding additional detergent solution from the mixing tank 80 as required. The larger the clothes load the more detergent solution is required. Once the mixing tank 80 is emptied, fresh water is added through the detergent water valve 40,42 and 76 as required by the water level sensor 140.

Tumble Wash Cycle

The high speed spin/recirculation portion of the cycle is terminated after the designated time and the detergent tank control valve 128 is opened with a five second time delay to permit the draining of any remaining detergent solution into the tub 34. The detergent mixing valve 170 is turned on and the detergent water valves and water fill valves 45, 76 are opened to rinse out the detergent mixing tank 80 and begin a dilution fill as shown in step 512.

The fill volume for the tumble wash for step 514 can be indirectly inferred through volume of water used in the concentrated spray wash portion of the cycle in a system utilizing computer control. In more traditional electromechanical control systems, some other method or methods must be used to regulate the fill; i.e., flow regulated timed fill for maximum load volumes, motor torque, and pressure switches.

This second concentrated detergent solution spray portion of the wash cycle differs from the first in that the spin speed should now be reduced below that which will create a one gravity centrifugal force, to ensure the clothes load can loosely tumble, while a somewhat diluted yet still concentrated spray liquor is applied. In this step (514), the concentrated detergent solution is diluted somewhat, but not so much as to reduce the concentration to the normal concentration level of 0.05%–0.28%. Thus, the detergent concentration in this step will be above 0.28%. The additional water dilution is necessary due to the reduced extraction in the tumble mode versus the high speed spin mode. That is, with the centrifugal force reduced, the clothes load will hold a greater volume of wash fluid prior to saturation. This preferred second mode permits a further improvement in the level of uniformity of application of concentrated liquor and ultimately the uniform removal of soils. During the second mode of concentration liquor application, significant performance levels can be achieved due to specific designing/engineering of the application of thermal inputs to capitalize on the chemical benefits for specific detergent components not normally available in traditional horizontal wash systems.

The utilization of the recirculated spray throughout the tumble portion of the wash recycles wash liquor draining through holes 36 in either the fully perforated basket or the nearly solid basket provides water conservation, and further assists in the application of wash liquor flow through and over the wash load. The hardware utilized for the concentrated spray wash portion of the cycle effectively fits the requirements.

There are opportunities for modifications to the tub and sump to minimize suds lock conditions and more efficient spray applications by directing the wash liquor return directly and promptly to the pump with minimal aeration of the detergent liquor. Accumulation of concentrated detergent liquor in areas other than the orifice to the pump, such as between the tub and the basket, increases the risk of the spinning/tumbling basket contacting the liquor and mechanically aerating it to the point which negatively affects recirculated spray flow patterns and remaining detergent liquor throughout the recirculation plumbing.

The tumbling portion of the cycle has the objective to provide sufficient detergent liquor fluid flow "through" and "over" the clothes load combined with fabric flexing and flagging. The resulting wash liquor flow patterns appear as complex non-laminar flow, fundamental in classical removal of micelle formations sequestering both oily and particulate soils.

One of the objectives of this wash system is to minimize water consumption. While the preferred design utilizes a perforated basket, other system could utilize nearly solid baskets. Opportunities by a near solid basket include increased ease of maintain concentrated wash liquor in the clothes load and basket. The lack of basket holes reduces the rate and level of extraction of wash liquor and allows the wash liquor to increase its contact time with the clothes instead of reduced contact time required for recirculation through plumbing.

Other designs utilize non-perforated baskets or nearly solid baskets without recirculation. Such designs increase the ability of the system to achieve higher levels of chemical effectiveness in the basket and the clothes load without losses due to plumbing hardware. These washability performance achievements and accompanying reductions in the total water consumption are obtained by the elimination of the volume of the recirculation system, thus the remaining chemistry is concentrated in a lower volume of water.

The gentle tumbling wash action even of this elevated detergent concentration solution provides barely enough mechanical energy input to offer consumers only a minimally acceptable wash performance. Thus, the preferred cycle includes the use of an initial highly concentrated detergent solution wash step as described above.

The type and length of tumbling action varies with the cycl desired. For example, maximum time may be selected for maximum soil removal, while lesser times offer less fluid flow and fabric flexing for delicates, silks, wools, sweaters, and other fine washables. If bleach is being added, then valves 45, 74 are opened to allow a maximum of one quarter cup of liquid chlorine bleach. The physical size of the bleach dispenser 62 can be used to prevent over dosage or a bulk dispenser can be used to regulate dispensing at the appropriate ratio to the volume of water used in the concentrated detergent solution tumble portion of the wash cycle.

In some embodiments where extremely high temperatures are used during the tumble wash, water is added at the end of the tumble wash cycle to cool the clothes load, and the wash water.

The end of the concentrated tumble wash is characterized by a tumble drain followed by complete extraction of wash liquor from the clothes load, basket 35 and tub 34 in step 516. The spin speeds are staged so that the load balances itself and reduces the undesired opportunities for suds lock conditions.

All systems described above can use either spray, spray tumble, flush rinses, and/or combinations for effective rinsing and water conservation. The perforated basket design can also use a flush rinse technique.

The Rinse Cycle

Recirculated Spray Rinse Cycle

Figure 6A:
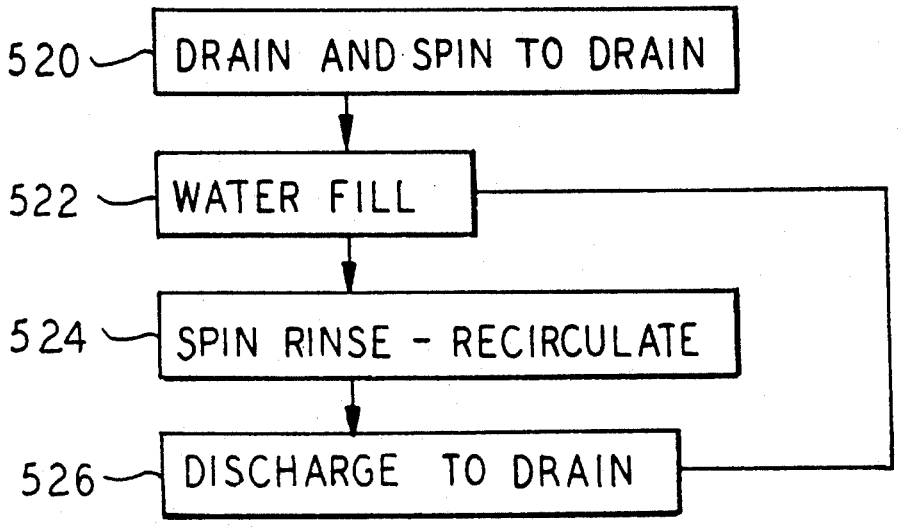
FIG. 6A is a flow chart diagram of a recirculation rinse cycle.

The recirculated spray rinse portion of the cycle, whether the basket is spun at a high speed to effect a centrifugal force greater than gravity or a slower speed to cause the fabric load to tumble as illustrated in FIG. 6A, represents a water conservation feature for any horizontal axis washer. Its preferred usage is in combination with concentrated detergent solution concepts to reduce the risk of potential soil redeposition, but is not limited to those designs or methods. The exact hardware utilized for high performance spray washing can be utilized without modification to provide rinsing performance comparable to a classical deep tumble rinse of approximately twenty gallons. The horizontal recirculated spray rinse cycle uses six to twelve serial recirculated spray rinse cycles, consuming approximately one gallon of water each, to provide rinsing, defined by removal of LAS containing surfactants, of a level comparable to that achieved by three to five deep tumble rinses of four to five gallons each. A combination of spin recirculated and tumble recirculated rinses provides more uniform rinsing with improved uniformity of final results.

The basket continues to spin after the final extract of the wash liquor with a fifteen second time delay to assure that all of the wash liquor has been pumped down the drain as shown in step 520. In step 522, the cold water valve 45 and 76 are opened until the water level sensor 140 is satisfied and then closed.

In step 524, the fresh water is sprayed directly onto the spinning clothes load. The water dilutes the detergent in the clothes as it passes through the load and basket. The rinse water drains down into the tub and is pumped back through the nozzle 51 to form a recirculation loop. The solution extracts additional detergent from the load with each pass. Each recirculation loop is delayed thirty seconds, after which the drain valve 166 is turned off and the solution is discharged to the drain as shown in step 526. The drain valve 166 is turned on and the spray rinse loop is repeated for the specified number of spray recirculations.

In the preferred embodiment, rinse water is added while the clothes tumble in the basket, and water is sprayed on the clothes load. When the water level control is satisfied, the basket accelerates to a speed sufficient to effect a centrifugal force in excess of one gravity. After some time, the rinse water is drained and the basket slows to tumble speed. The cycle is repeated for the specified number of spray recirculations.

On the last spray rinse the fabric softener valve 72, and cold water fill valve 45 is opened for thirty seconds permitting the fabric softener to be rinsed into the tub 34 and pump 38. Cold water and fabric softener valves 45, 72 are closed and the fabric softener is mixed with the last recirculating rinse water. The resulting solution is sprayed onto the clothes load in a recirculation loop for an additional two minutes to assure uniform application of the fabric softener. Additional fresh water is added through the cold water fill valve 42 if the water level sensor 140 becomes unsatisfied. In the final step 526, the drain valve 166 is turned off permitting the final extraction of water and excess softener for sixty seconds.

Spray Flush Rinse Cycle

Figure 6B:
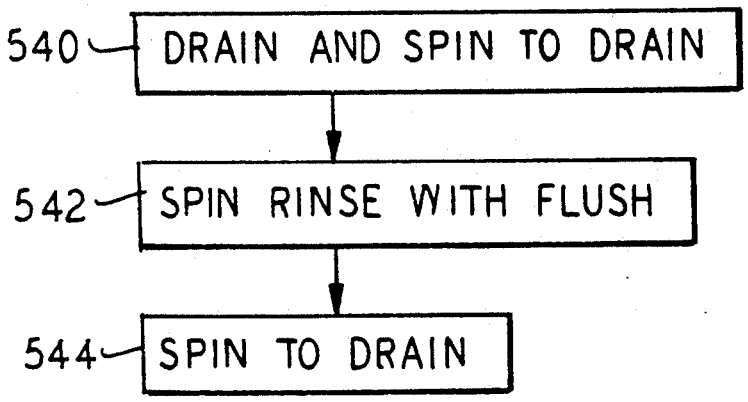
FIG. 6B is a flow chart diagram of a flush rinse cycle.

Spray flush as shown in FIG. 6B offer a less than optimum performance option for perforated basket designs. The limiting parameter for this system results from the lack of uniform spray coverage and problems associated with the lack of guaranteed water line pressures. The design does not require any additional hardware and consumes small volumes of water in matching the rinse performance of a deep rinse.

In step 540 the basket 35 continues to spin after the final extract of the wash liquor with a fifteen second time delay to assure all of the wash liquor has been pumped down the drain. The cold water valve 45 is opened until the timer is satisfied and then closed. In step 542, the fresh water is sprayed directly onto the spinning clothes load and directly down the drain by means of the closed drain valve 166. On the last flush spray rinse the fabric softener valve 72 and fill valve 45 are opened for thirty seconds permitting the fabric softener to be rinsed into the tub 34 and pump. Cold water and fabric softener valves 45, 72, are closed and the fabric softener is mixed with the last recirculating rinse water. The resulting solution is sprayed onto the clothes load in a recirculation loop for an additional two minutes to assure uniform application of th fabric softener. Additional fresh water is added through the cold water fill valve 45 if the water level sensor 140 becomes unsatisfied. The drain valve 166 is turned off permitting the final extraction of water and excess softener for sixty seconds in step 544.

As is apparent from the foregoing specification, the invention is susceptible of being embodied with various alterations and modifications which may differ particularly from those that have been described in teh preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A method of rinsing fabric in a washer having a wash chamber rotatable about a horizontal axis comprising the steps:

loading fabric to be washed into the wash chamber of said washer;

washing said fabric in a detergent solution while rotating said wash chamber about its horizontal axis for a first period of time;

draining said detergent solution from said wash chamber subsequent to said first period of time;

rinsing said fabric by adding water to said wash chamber and spraying said rinse water onto said fabric while spinning said wash chamber at a speed to effect more than a one gravity centrifugal force on said fabric such that said fabric will not tumble within said wash chamber as it spins;

draining said wash chamber of said rinse water.

2. A method of rinsing fabric according to claim 1, wherien said rinse water is recirculate d within said wash chamber.

3. A method of rinsing fabric according to claim 1, wherein said rinse water is directed to a drain after leaving said fabric without any recirculation thereof.

4. A method of rinsing fabric according to claim 1, wherein said step of washing said fabric comprises washing said fabric in a concentrated detergent solution of at least 0.5% detergent by weight.

5. A method of rinsing fabric according to claim 1, wherein said steps of draining each comprise spinning said wash chamber.

6. A method of rinsing fabric according to claim 1, wherein said step of rinsing comprises adding water to said wash chamber with said wash chamber rotating at a tumble speed, subsequently increasing the rotation speed of said wash chamber and recirculating said rinse water while said wash chamber is rotating at a speed to effect more than a one gravity centrifugal force on said fabric, and said draining step comprises decelerating said rotational speed of said wash chamber to the tumble speed.

7. A method of rinsing fabric in a washer having a wash chamber rotatable about a horizontal axis comprising the steps:

rinsing said fabric by adding and recirculating water to and within said wash chamber and spraying said rinse water onto said fabric while spinning said wash chamber at a speed to effect more than a one gravity centrifugal force on said fabric such that said fabric will not tumble within said wash chamber as it spins;

draining said wash chamber of said rinse water.

8. A method of rinsing fabric according to claim 7, wherein said step of draining comprises spinning said wash chamber.

9. A method of rinsing fabric according to claim 7, including the step of:

washing said fabric in a concentrated detergent solution of at least 0.5% by weight detergent before said step of rinsing said fabric.

10. A method of rinsing fabric according to claim 9, wherein said step of washing said fabric comprises spinning said wash chamber at a speed to effect less than a one gravity centrifugal force such that said fabric will tumble within said wash chamber as it spins.

11. A method of rinsing fabric according to claim 7, wherein said step of rinsing comprises adding water to said wash chamber with said wash chamber rotating at a tumble speed, subsequently increasing the rotation speed of said wash chamber and recirculating said rinse water while said wash chamber is rotating at a speed to effect more than a one gravity centrifugal force on said fabric, and said draining step comprises decelerating said rotational speed of said wash chamber to the tumble speed.

12. A method of rinsing fabric in a washer having a wash chamber rotatable about a horizontal axis comprisnig the steps:

loading fabric to be washed into the wash chamber of said washer;

washing said fabric in a detergent solution having a concentration of at least 0.5% by weight detergent while rotating said wash chamber about its horizontal axis for a first period of time;

draining said detergent solution from said wash chamber subsequent to said first period of time by spinning said wash chamber;

rinsing said fabric by adding water to said wash chamber and spraying said rinse water onto said fabric while spinning said wash chamber at a speed to effect more than a one gravity centrifugal force on said fabric such that said fabric will not tumble within said wash chamber as it spins;

draining said wash chamber of said rinse water by spinning said wash chamber.

13. A method of rinsing fabric according to claim 12, wherein said rinse water is recirculated within said wash chamber.

14. A method of rinsing fabric according to claim 12, wherein said rinse water is directed to a drain after leaving said fabric without any recirculation thereof.

15. A method of rinsing fabric according to claim 12, wherein said step of draining comprises spinning said wash chamber.

16. A method of rinsing fabric according to claim 12, wherein said step of rinsing comprises adding water to said wash chamber with said wash chamber rotating at a tumble speed, subsequently increasing the rotation speed of said wash chamber and recirculating said rinse water while said wash chamber is rotating at a speed to effect more than a one gravity centrifugal force on said fabric, and said draining step comprises decelerating said rotational speed of said wash chamber to the tumble speed.

* * * * *